US006257899B1

(12) United States Patent
Walkup

(10) Patent No.: US 6,257,899 B1
(45) Date of Patent: Jul. 10, 2001

(54) SOFT INTERNAL TOUCH CONTACT FOR IC SOCKET

(75) Inventor: William B. Walkup, Hillsboro, OR (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/625,695

(22) Filed: Jul. 26, 2000

(51) Int. Cl.[7] ..... H01R 12/00
(52) U.S. Cl. ..... 439/66; 439/83; 439/515
(58) Field of Search ..... 439/71, 83, 515, 439/66

(56) References Cited

U.S. PATENT DOCUMENTS 4,052,118 * 10/1977 Scheingold et al. ..... 439/71
4,354,729 * 10/1982 Grabbe et al. ..... 439/733.1
4,358,173 * 11/1982 Conrad ..... 439/71
4,370,017 * 1/1983 Grabbe et al. ..... 439/862
4,376,562 * 3/1983 Kaley ..... 439/264
4,513,353 * 4/1985 Bakersmans et al. ..... 361/399
4,553,192 * 11/1985 Babuka et al. ..... 361/395
4,655,519 * 4/1987 Evans et al. ..... 439/74
4,761,140 * 8/1988 Geib ..... 439/71
4,959,029 * 9/1990 Grabbe ..... 439/862
5,067,904 * 11/1991 Takeuchi et al. ..... 439/73
5,092,783 * 3/1992 Suarez et al. ..... 439/71
5,653,598 * 8/1997 Grabbe ..... 439/66
5,924,874 * 7/1999 Gotoh et al. ..... 439/73
5,997,317 * 12/1999 Pei et al. ..... 439/83
6,069,481 * 5/2000 Matsumura ..... 324/755
6,116,923 * 9/2000 Szu ..... 439/83

* cited by examiner

*Primary Examiner*—Neil Abrams
(74) *Attorney, Agent, or Firm*—Wei Te Chung

(57) ABSTRACT

A soft internal touch contact (1) for a Land Grid Array (LGA) socket (4) for interconnecting an LGA package (5) with a printed circuit board (PCB) (6) comprises first and second spring arms (13, 14) on opposite ends thereof, and a solder portion (16) between the first and second spring arms for being soldered to the PCB. The first and second spring arms have first and second free end sections (134, 144) respectively defining a downwardly and an upwardly facing inclined surfaces (136, 146) for engaging with each other thereby establishing a shortened electrical path between the LGA package and the PCB. Upon downward deflection of the first spring arm by the LGA package to engage with the second spring arm, the second spring arm correspondingly yields downward whereby a wiping action is generated between the downwardly and upwardly facing inclined surfaces along a direction substantially tangential to the inclined surfaces and also between the first spring arm and a contact pad (50) of the LGA package. To relieve stresses, a pair of wings (162) is formed on the solder portion to be loosely received in slots (44) in an insulative housing (40) of the LGA socket.

11 Claims, 7 Drawing Sheets

SOFT INTERNAL TOUCH CONTACT FOR IC SOCKET

SPECIFICATION

BACKGROUND OF THE INVENTION

1. Field of the Invention

The present invention relates to an internal touch contact for an integrated circuit (IC) socket, and particularly to a soft internal touch contact for a land grid array (LGA) socket for facilitating signal transmission between an IC package and a printed circuit board (PCB).

2. Description of Prior Art

IC packages having leads arranged in a land grid array (LGA) are well known as LGA packages. The LGA packages have a relatively low height, which is desirable for saving space in electronic assemblies.

Connectors for removably mounting an LGA package on a PCB are known as LGA sockets. An LGA socket typically comprises a substantially flat dielectric housing which is positioned between the LGA package and the PCB. The housing defines an array of passageways with electrical contacts received therein in correspondence with the array of leads of the LGA package. Each contact has a pair of oppositely extending free ends spaced apart a predetermined distance in an original position. The two free ends project beyond external surfaces of the socket housing for respectively engaging with corresponding contact pads on a bottom surface of the LGA package and on a top surface of the PCB. When the LGA package is sandwiched between the socket and the PCB, the two free ends of each contact are compressed to contact each other thereby shortening the signal transmission path. Typically, the compressive force may be applied by pressure plates which are fastened together to sandwich the package, the socket and the PCB therebetween. Even if the two free ends of the contact fail to contact each other, the signal can still be transmitted through the contact but along a relatively longer path. This kind of contact is called an internal touch contact.

Various internal touch contacts for LGA sockets are disclosed in the prior art. One problem encountered with the conventional internal touch contacts, such as those disclosed in U.S. Pat. Nos. 4,262,986; 4,268,102 and 5,092,783, is that one of the two free ends of the contact is constructed as a flat, non-yielding part whereby the normal force required to establish the contact interface is increased so sharply that it has proven difficult to control it within desired limits. The increased normal force generally has a negative effect on connector performance. Therefore, it is desired to have a soft internal touch contact that operates using a small normal force.

U.S. Pat. Nos. 4,354,729; 4,511,197 and 4,969,826 disclose internal touch contacts having free ends thereof engaged with each other via side edges thereof. As such contacts become increasingly miniaturized, and as the thickness of the contacts is decreased, it becomes increasingly difficult to mate the side edges of the two free ends of the contact. Hence, a contact having free ends thereof engaged with each other via major surfaces thereof is also required to ensure reliable internal contact performance.

Furthermore, the conventional LGA sockets do not provide solutions to CTE (Coefficient of Thermal Expansion) problems. During cooling after the contacts are soldered to corresponding contact pads of the PCB, stresses resulting from a difference between the CTEs of the socket housing and the PCB will develop in the soldered connections between the contact and the PCB, possibly causing failure of soldered connections. Additionally, when there is a large change in environmental temperature, larger stresses can develop in the soldered connections. Accordingly, an improved LGA socket is required to overcome the above disadvantages of conventional LGA sockets.

SUMMARY OF THE INVENTION

Accordingly, one object of the present invention is to provide a soft internal touch contact for an LGA socket that has free ends deflectable under load which engage with one another using only a small normal force.

Another object of the present invention is to provide a soft internal touch contact for an LGA socket that has free ends engagable with each other via major surfaces thereof for ensuring a reliable engagement therebetween.

A further object of the present invention is to provide an LGA socket having contacts loosely received therein for relieving stresses resulting from a difference between CTEs of a housing thereof and a mating printed circuit board.

In order to achieve the objects set forth, a soft internal touch contact for an LGA socket in accordance with the present invention comprises first and second spring arms formed on opposite ends thereof and a solder portion between the first and second spring arms for being soldered to a contact pad of a PCB. The first spring arm has a curved engaging section for engaging with a contact pad of an LGA package and a first free end section having a downwardly facing inclined surface. The second spring arm has a second free end section having an upwardly facing inclined surface facing the downwardly facing inclined surface of the first spring arm.

Upon downward deflection of the first spring arm to engage with the second spring arm, the second spring arm correspondingly yields downward whereby a wiping action is generated between the downwardly and upwardly facing inclined surfaces of the respective first and second spring arms along a direction substantially tangential to the inclined surfaces and also between the curved engaging section of the first spring arm and the contact pad of the LGA package along a horizontal direction. Accordingly, the normal force is significantly reduced during the mutual engagement between the first and second spring arms, and a shortened electrical path is thus established between the LGA package and the PCB.

To relieve stresses resulting from a difference between CTEs of an insulative housing of the LGA socket and the PCB under a wide range of environmental temperatures, a pair of wings is formed on the solder portion of the contact for being loosely received in upwardly exposed slots of the insulative housing of the LGA socket.

Other objects, advantages and novel features of the invention will become more apparent from the following detailed description when taken in conjunction with the accompanying drawings.

DETAILED DESCRIPTION OF PREFERRED EMBODIMENTS

Figure 1:
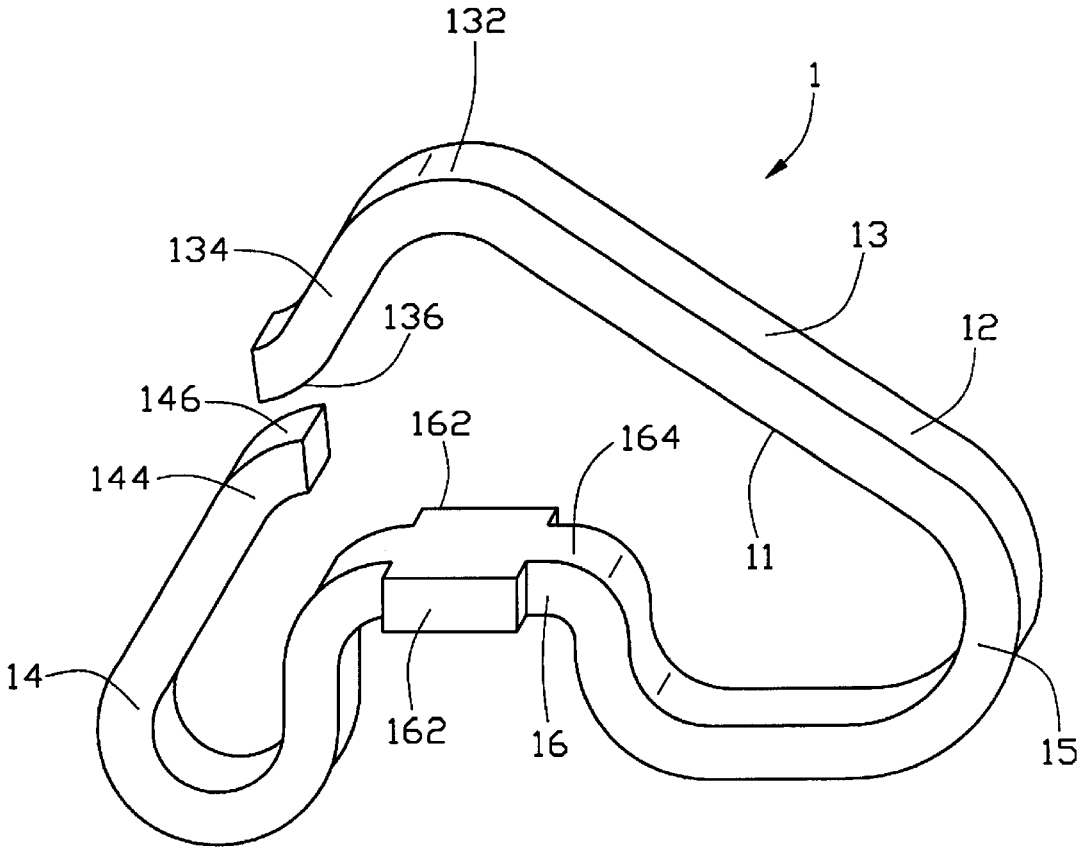
FIG. 1 is a perspective view of a soft internal touch contact for an LGA socket in accordance with a first embodiment of the present invention.

For facilitating understanding, like components are designated by like reference numerals throughout the various embodiments of the invention as shown in the various drawing figures.

Reference will now be made to the drawing figures to describe the present invention in detail.

Figure 2:
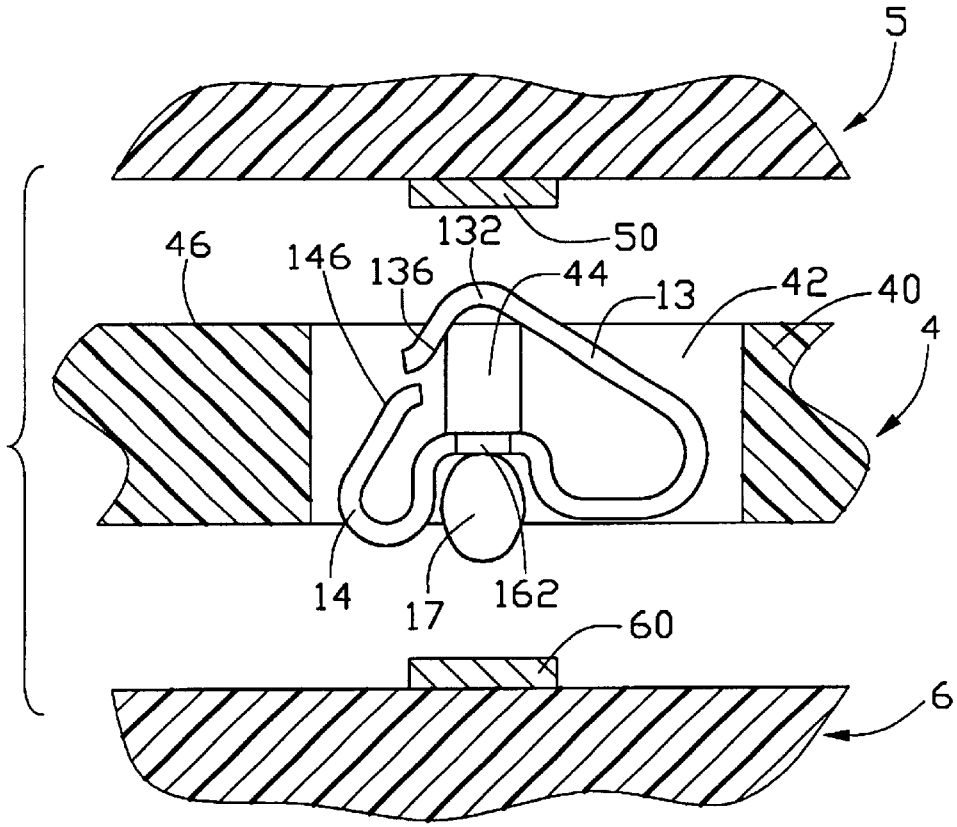
FIG. 2 is a partial, cross-sectional view of an LGA socket with the soft internal touch contact of FIG. 1 received therein in an original position for interconnecting an LGA package with a PCB.
Figure 3:
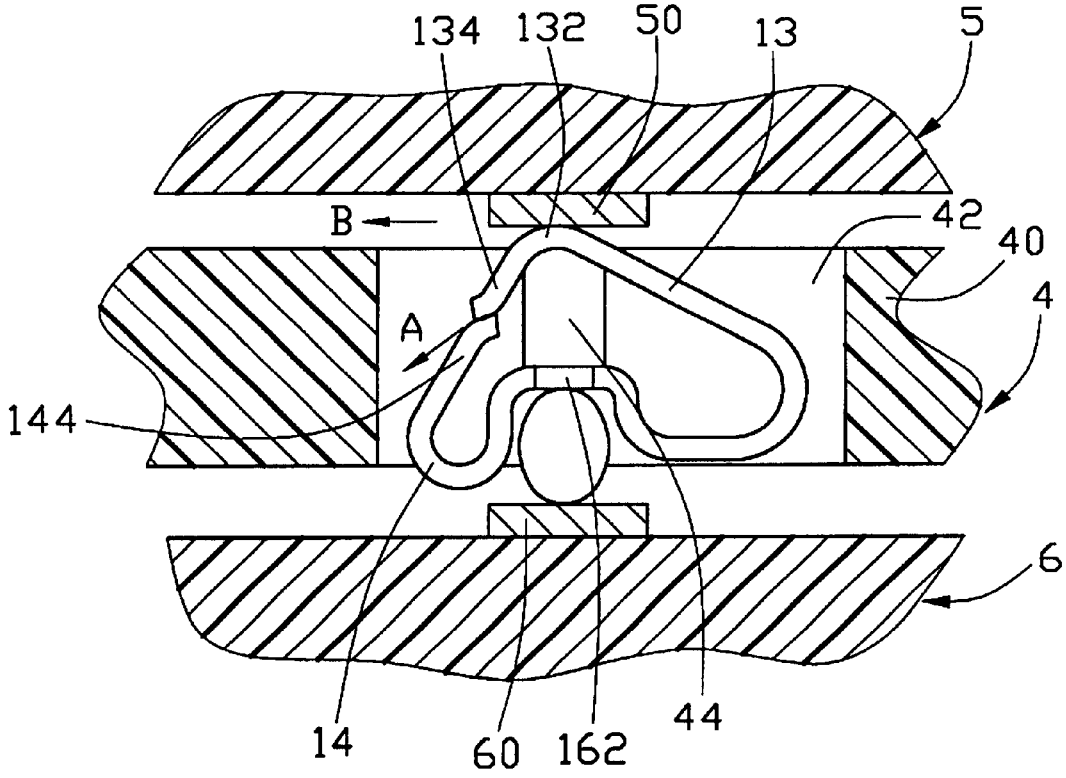
FIG. 3 is a view similar to FIG. 2 showing the soft internal touch contact of FIG. 1 in a deflected position and engaged with the LGA package and the PCB.

Referring to FIGS. 1–3, a soft internal touch contact 1 for a Land Grid Array (LGA) socket 4 in accordance with a first embodiment of the present invention is shown. The soft internal touch contact 1 is formed from a metal sheet to form a contact body having first and second major surfaces 11 and 12 corresponding to opposite side surfaces of the metal sheet. The contact 1 includes first and second spring arms 13 and 14 on opposite ends thereof, a bight portion 15 extending from the first spring arm 13, and an inverted U-shaped solder portion 16 connecting the bight portion 15 with the second spring arm 14. The solder portion 16 forms a pair of wings 162 on lateral sides of a horizontal section 164 thereof, the function of which will be described later. The first spring arm 13 has a curved engaging section 132, and a first free end section 134 having a downwardly facing inclined surface 136 which is a part of the first major surface 11. The second spring arm 14 comprises a second free end section 144 having an upwardly facing inclined surface 146 which is a part of the second major surface 12. The first and second free end sections 134 and 144 extend toward each other with respective inclined surfaces 136 and 146 thereof facing each other. Preferably, the downwardly facing inclined surface 136 is inclined more steeply than the upwardly facing inclined surface 146.

The contact 1 is received in a contact receiving cavity 42 defined in a housing 40 of the LGA socket 4 with the curved engaging section 132 thereof projecting from an upper surface 46 of the housing 40 for engaging with a contact pad 50 of an LGA package 5. A solder ball 17 is attached to the solder portion 16 of the contact 1 for being soldered to a contact pad 60 of a printed circuit board (PCB) 6 thereby connecting the LGA socket 4 with the PCB 6.

Figure 4:
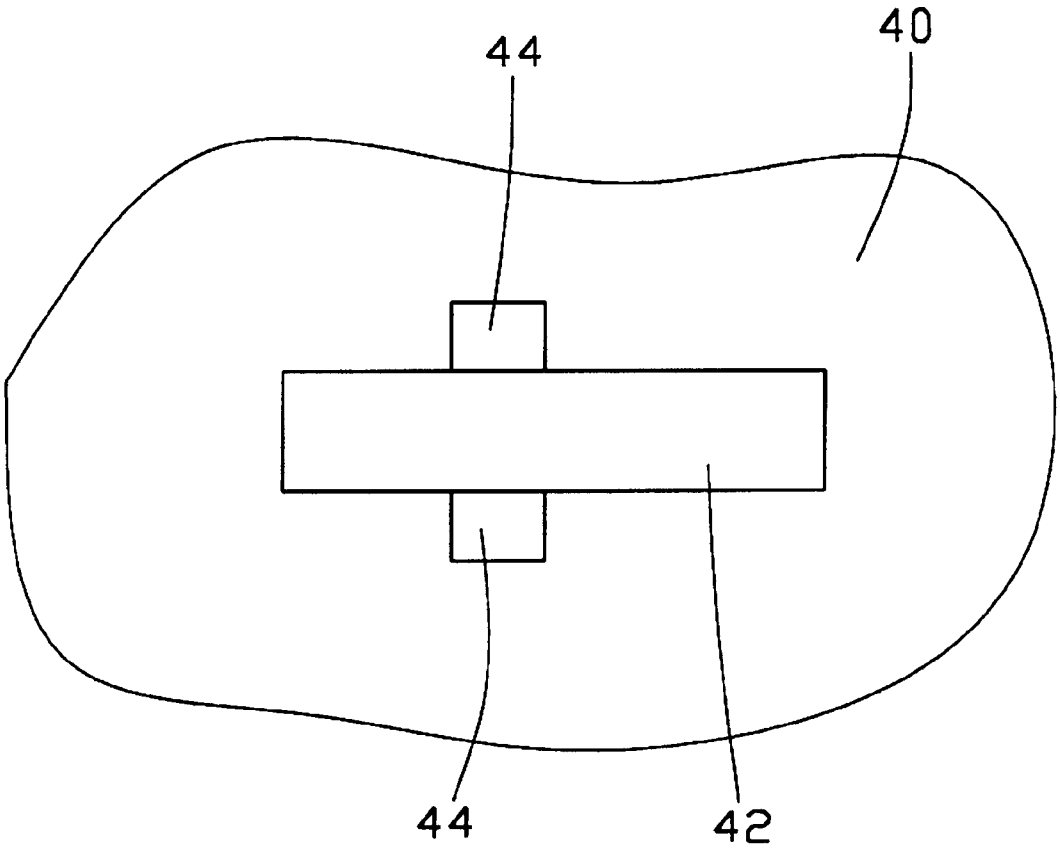
FIG. 4 is a top, plan view of a portion of a housing of the LGA socket of FIG. 2 showing a contact receiving cavity.

During cooling following the soldering operation between the LGA socket 4 and the PCB 6, stresses which result from a difference between the CTEs of the housing 40 and the PCB 6 can develop in the soldering joints formed by the solidifying melted solder balls 17, thereby causing a possibility of fatigue failure (breakage) in the connection. To relieve the stresses, a pair of upwardly exposed slots 44 (best seen in FIG. 4) is provided on opposite lateral sides of the cavity 42 in communication with the cavity 42. The pair of slots 44 loosely accommodate the wings 162 of the contact 1, with bottom surfaces of the wings 162 resting on inner bottom surfaces of the slots 44. The slots 44 allow movement between the contact 1 and the housing 40. Accordingly, the housing 40 can more easily expand and contract without causing high stress in the soldered connection between the contact 1 and the PCB 6, thereby ensuring a reliable electrical connection therebetween.

To accurately position the contact 1 in the cavity 42 of the housing 40, a locator (not shown) is required to accurately press the contact 1 into the cavity 42. Once the solder ball 17 is soldered to the contact pad 60 of the PCB 6, the locator can be removed and discarded or recycled.

As shown in FIG. 3, when the LGA package 5 is downwardly pressed to engage with the LGA socket 4 with the contact pad 50 thereof contacting the engaging section 132, the first spring arm 13 of the contact 1 is depressed to engage with the second spring arm 14 whereby the flexible second spring arm 14 correspondingly yields downward to reduce the normal force between the engaged first and second spring arms 13, 14. The LGA package 5 and the PCB 6 are thus interconnected by the LGA socket 4 and a shortened electrical path is established between the curved engaging section 132 and the second spring arm 14. During the engagement between the first and second spring arms 13 and 14, the downwardly facing inclined surface 136 of the first spring arm 13 wipes the upwardly facing inclined surface 146 of the second spring arm 14 along a direction A substantially tangential to the inclined surfaces 136 and 146. There is also a wiping action in a horizontal direction B between the curved engaging section 132 of the contact 1 and the contact pad 50 of the LGA package 5, whereby contaminates built up on the contact pad 50 can be removed to ensure a reliable electrical connection therebetween. These wiping actions significantly reduce the normal force between engaging surfaces compared to conventional designs wherein a spring arm analogous to the first spring arm 13 engages with a flat, non-yielding part.

Figure 5:
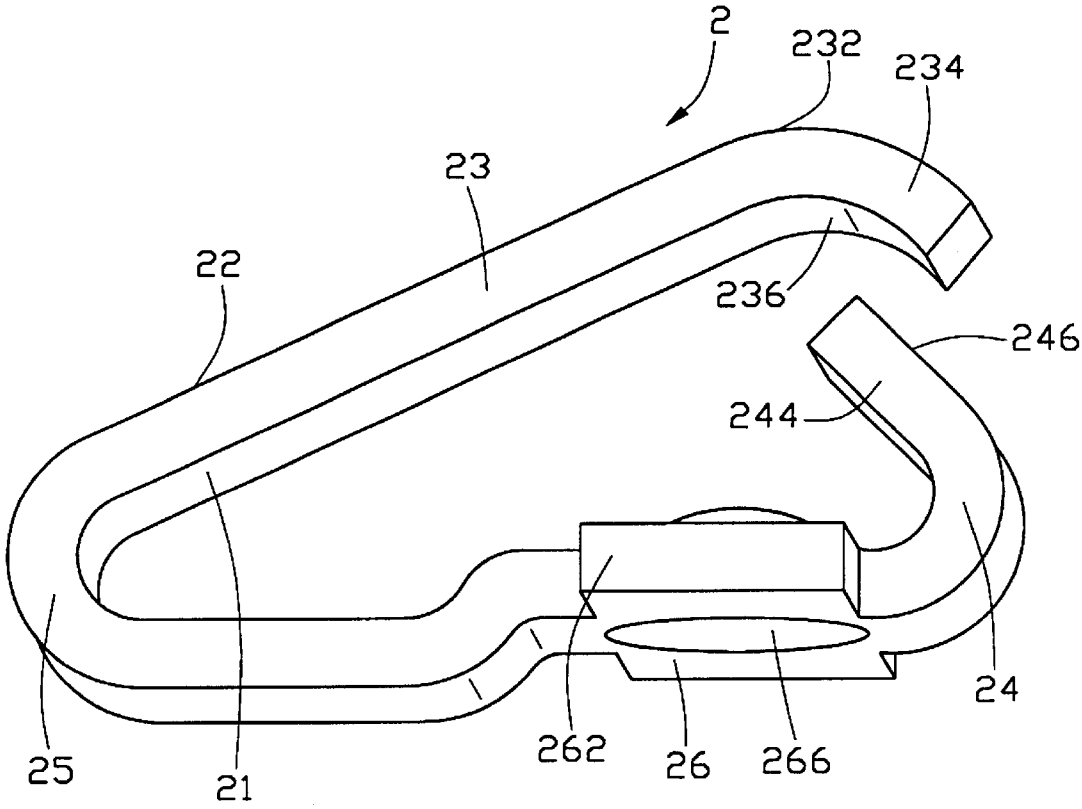
FIG. 5 is a perspective view of a soft internal touch contact for an LGA socket in accordance with a second embodiment of the present invention.
Figure 6:
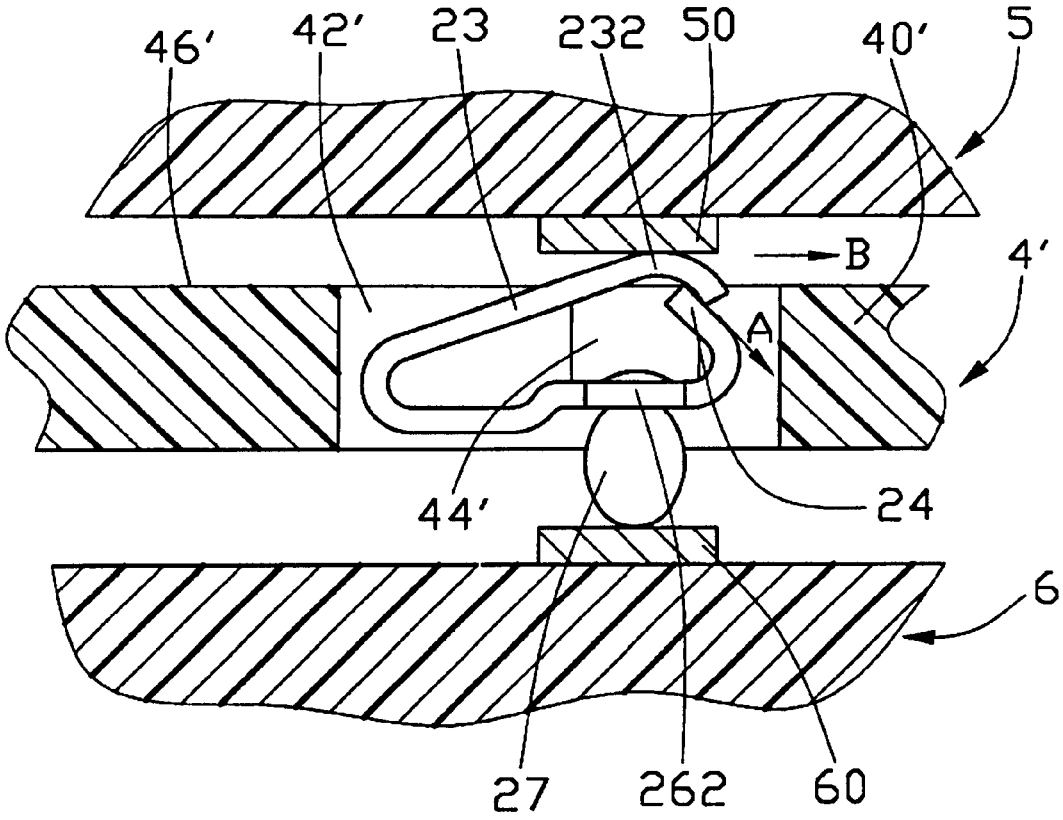
FIG. 6 is a partial, cross-sectional view of an LGA socket with the soft internal touch contact of FIG. 5 received therein, the contact being engaged with an LGA package and a PCB and in a deflected position.

A soft internal touch contact 2 for an LGA socket 4' in accordance with a second embodiment of the present invention is shown in FIGS. 5 and 6. The soft internal touch contact 2 has a configuration similar to the contact 1 shown in FIG. 1, including first and second spring arms 23 and 24, a bight portion 25 and a solder portion 26. The first spring arm 23 has a first free end section 234 having a downwardly facing inclined surface 236 which is a part of a first major surface 21 of the contact body. The second spring arm 24 comprises a second free end section 244 having an upwardly facing inclined surface 246 which is a part of a second major surface 22 of the contact body. The solder portion 26 has a pair of wings 262 and a hole 266 defined in the bottom thereof for partially receiving a solder ball 27 therein, thereby retaining the original shape of the solder ball 27.

The contact 2 is positioned by a locator in a contact receiving cavity 42' defined in a housing 40' of the LGA socket 4' with a curved engaging section 232 of the first spring arm 23 projecting from an upper surface 46' of the housing 40' for engaging with the contact pad 50 of the LGA package 5. To relieve stresses, the wings 262 of the solder portion 26 of the contact 2 are loosely received in slots 44' on opposite lateral sides of the cavity 42'. The LGA socket 4' is connected with the PCB 6 via the solder balls 27.

As is clearly shown in FIG. 6, when the LGA package 5 is downwardly pressed to engage with the LGA socket 4', the first spring arm 23 of the contact 2 is depressed to engage with the second spring arm 24 whereby the flexible second spring arm 24 correspondingly yields downward to reduce the normal force between engaging surfaces. The LGA package 5 and the PCB 6 are thus interconnected by the LGA socket 4' and a shortened electrical path is established between the curved engaging section 232 and the second spring arm 24. During the engagement between the first and second spring arms 23 and 24, a wiping action is generated between the downwardly facing inclined surface 236 and the upwardly facing inclined surface 246 along a direction A substantially tangential to the inclined surfaces 236 and 246. There is also a wiping action in a horizontal direction B between the curved engaging section 232 of the contact 2 and the contact pad 50 of the LGA package 5 to ensure a reliable electrical connection therebetween. These wiping actions significantly reduce the normal force between engaging surfaces.

Figure 7:
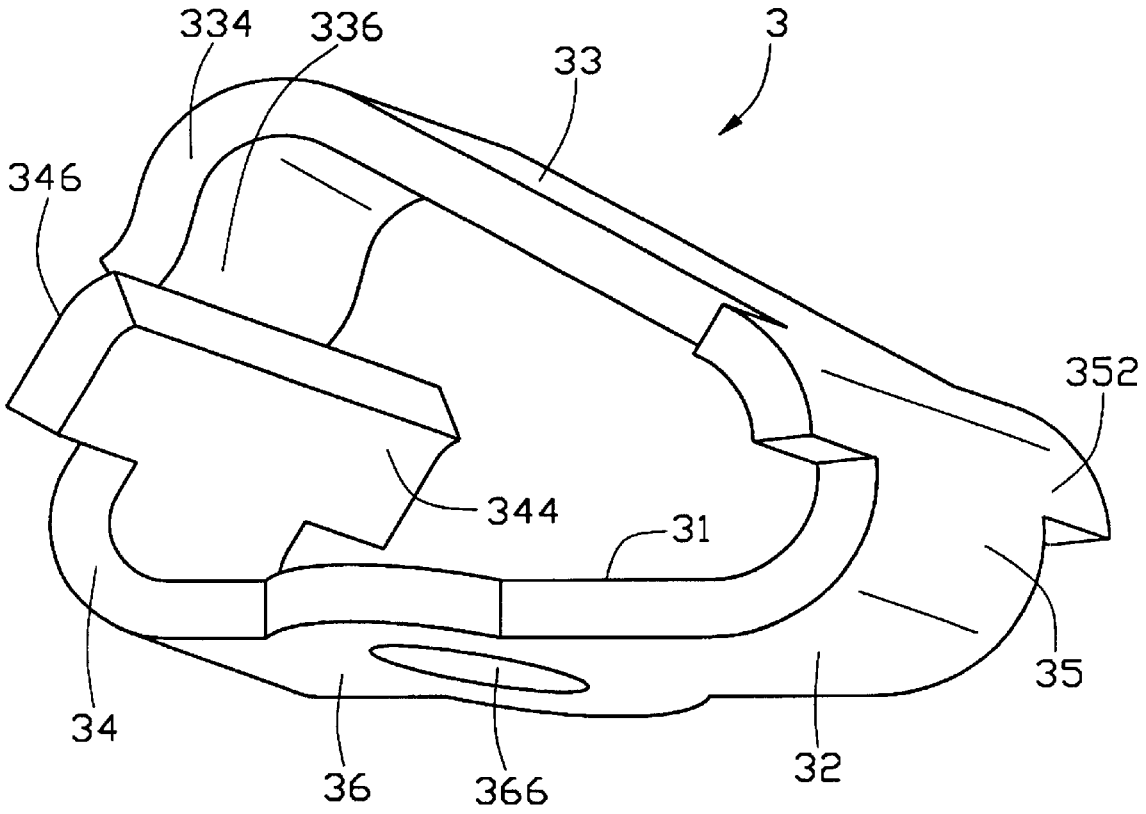
FIG. 7 is a perspective view of a soft internal touch contact for an LGA socket in accordance with a third embodiment of the present invention.

FIG. 7 shows a soft internal touch contact 3 for an LGA socket (not shown) in accordance with a third embodiment of the present invention. Upon downward depression, the first and second spring arms 33 and 34 are further engaged with each other, whereby a wiping action is generated between a downwardly facing inclined surface 336 of the first free end section 334 which is a part of a first major surface 31 of the contact body and an upwardly facing inclined surface 346 of the second free end section 344 which is a part of a second major surface 32 of the contact body. The second free end section 344 has an enlarged dimension relative to the contact body to further ensure a reliable engagement between the downwardly and upwardly facing inclined surfaces 336 and 346. A through hole 366 is defined in a solder portion 36 of the contact 3 for receiving a solder ball (not shown). A pair of wings 352 is formed on a bight portion 35 of the contact 3 instead of being formed on the solder portion 36.

As described above, it can be appreciated that the normal force between engaging surfaces of the contact of the present invention is significantly reduced due to the provision of deflectable first and second spring arms. The CTE problem is also overcome by forming a pair of wings on the contact which are loosely received in slots in the socket housing. Additionally, a reliable contact between first and second free end sections of the contact is also ensured since they are engaged with each other via major surfaces thereof corresponding to opposite side surfaces of the metal sheet from which the contact is formed.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A contact received in an integrated circuit (IC) socket for interconnecting an integrated circuit (IC) package with a printed circuit board (PCB), comprising:

a first spring arm formed on one end thereof having a curved engaging section for engaging with a contact pad of the IC package and a first free end section having a downwardly facing inclined surface;

a second spring arm formed on another end thereof having a second free end section, the second free end section having an upwardly facing inclined surface facing the downwardly facing inclined surface of the first spring arm; and a solder portion formed between the first and second spring arms for being soldered to a contact pad of the PCB; wherein when the first spring arm is depressed to engage with the second spring arm, the second spring arm correspondingly yields downward and the downwardly and upwardly facing inclined surfaces of the respective first and second spring arms come into mutual engagement whereby a shortened electrical path is thus established between the IC package and the PCB.

2. The contact as described in claim 1, wherein in the mutual engagement of the downwardly and upwardly facing inclined surfaces of the first and second spring arms, a wiping action is generated between the downwardly and upwardly facing inclined surfaces along a direction substantially tangential to the downwardly and upwardly facing inclined surfaces.

3. The contact as described in claim 2, wherein during the wiping action of the downwardly and upwardly facing inclined surfaces of the first and second spring arms, the curved engaging section of the first spring arm has a horizontal wiping action on the contact pad of the IC package.

4. The contact as described in claim 1, wherein the downwardly and upwardly facing inclined surfaces of the respective first and second spring arms are in correspondence with opposite side surfaces of a metal sheet from which the contact is formed.

5. The contact as described in claim 1, wherein the solder portion forms a pair of wings on lateral sides thereof for being loosely received in a housing of the IC socket.

6. The contact as described in claim 1, wherein the solder portion defines a hole for partially receiving a solder ball and for retaining the original shape of the solder ball.

7. The contact as described in claim 1, wherein the second free end section of the second spring arm has an enlarged dimension relative to remaining parts of the contact to ensure a reliable engagement with the first spring arm.

8. A contact received in an integrated circuit (IC) socket for interconnecting an integrated circuit (IC) package with a printed circuit board (PCB), comprising:

a first spring arm formed on one end thereof having a curved engaging section for engaging with a contact pad of the IC package and a first free end section having a downwardly facing inclined surface;

a second spring arm formed on another end thereof having a second free end section, the second free end section having an upwardly facing inclined surface facing the downwardly facing inclined surface of the first spring arm; and a solder portion formed between the first and second spring arms for being soldered to a contact pad of the PCB; wherein upon downward deflection of the first spring arm to engage with the second spring arm, the second spring arm correspondingly yields downward whereby a wiping action is generated between the downwardly and upwardly facing inclined surfaces of the respective first and second spring arms along a direction substantially tangential to the inclined surfaces, and also between the curved engaging section of the first spring arm and the contact pad of the IC package along a horizontal direction.

9. An integrated circuit (IC) socket for interconnecting an integrated circuit (IC) package with a printed circuit board (PCB), comprising:

an insulative housing defining a plurality of contact receiving cavities, each contact receiving cavity having a pair of upwardly exposed slots respectively on opposite lateral sides thereof; and a plurality of contacts received in corresponding contact receiving cavities of the insulative housing, each contact comprising:

a first spring arm formed on one end thereof having a curved engaging section for engaging with a contact pad of the IC package;

a second spring arm formed on another end thereof for engaging with the first spring arm to establish a shortened electrical path between the IC package and the PCB; and a solder portion formed between the first and second spring arms for being soldered to a contact pad of the PCB; and a pair of wings formed proximate to the solder portion for being loosely received in corresponding slots of the insulative housing thereby allowing relative movement between the contacts soldered to the PCB and the insulative housing when the insulative housing expands and contracts under different conditions of temperature.

10. The IC socket as described in claim 9, wherein the pair of wings is respectively formed on opposite lateral sides of the solder portion.

11. The IC socket as described in claim 9, further comprising a bight portion connecting the first spring arm with the solder portion, the pair of wings being respectively formed on opposite lateral sides of the bight portion.

* * * * *